US007040415B2

(12) United States Patent
Boyle et al.

(10) Patent No.: US 7,040,415 B2
(45) Date of Patent: May 9, 2006

(54) DOWNHOLE TELEMETRY SYSTEM AND METHOD

(75) Inventors: Bruce W. Boyle, Sugar Land, TX (US); Nicolas Pacault, Houston, TX (US); Jean-Michel Hache, Houston, TX (US); Remi Hutin, New Ulm, TX (US); Raghu Madhavan, Houston, TX (US); Jacques Jundt, Bethel, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 300 days.

(21) Appl. No.: 10/605,730

(22) Filed: Oct. 22, 2003

(65) Prior Publication Data

US 2005/0087368 A1 Apr. 28, 2005

(51) Int. Cl.
*E21B 7/04* (2006.01)

(52) U.S. Cl. ..... 175/40; 175/50

(58) Field of Classification Search ..... 166/250.01; 175/40, 50

See application file for complete search history.

(56) References Cited

U.S. PATENT DOCUMENTS

| | | | |
|---|---|---|---|
| 2,379,800 | A | 7/1945 | Hare |
| 3,696,332 | A | 10/1972 | Dickson, Jr. et al. |
| 3,807,502 | A | 4/1974 | Heilhecker et al. |
| 3,957,118 | A | 5/1976 | Barry et al. |
| 3,989,330 | A | 11/1976 | Cullen et al. |
| 4,051,456 | A | 9/1977 | Heilhecker et al. |
| 4,057,781 | A | 11/1977 | Scherbatskoy |
| 4,126,848 | A | 11/1978 | Denison |
| 4,605,268 | A | 8/1986 | Meador |
| 4,806,928 | A | 2/1989 | Veneruso |
| 4,901,069 | A | 2/1990 | Veneruso |
| 5,008,664 | A | 4/1991 | More et al. |
| 5,052,941 | A | 10/1991 | Hernandez-Marti et al. |
| 5,278,550 | A | 1/1994 | Rhein-Knudsen et al. |
| 5,339,037 | A | 8/1994 | Bonner et al. |
| 5,353,872 | A | 10/1994 | Wittrisch |

(Continued)

FOREIGN PATENT DOCUMENTS

EP 0 399 987 11/1990

(Continued)

OTHER PUBLICATIONS

McDonald, Dr. Willima J., "Four Basic Systems will be Offered," *Offshore*, Dec. 1977.

(Continued)

*Primary Examiner*—William Neuder
(74) *Attorney, Agent, or Firm*—Jennie Salazar; Victor H. Segura; Brigitte L. Echols

(57) ABSTRACT

A cabled communication link for a drill string includes spaced apart adapter subs within the drill string and a cable connecting the adapter subs for communication of a signal therebetween. The cabled communication link may be drill pipe joints are interconnected within the drill string between adapter subs to form a piped communication link, whereby the cabled communication link establishes a pathway to the piped communication link for transmitting a signal through the drill string. The cabled communication link may also be in a non-wired section of the drill string is disposed between adapter subs, whereby the cabled communication link establishes a pathway for transmitting a signal through the non-wired section of the drill string. Inductive couplings are preferably used for communication across the adapter subs and wired drill pipe joints. Another aspect of the cabled communication employs wireless transceivers at or near the surface of the wellbore.

60 Claims, 10 Drawing Sheets

U.S. PATENT DOCUMENTS

| | | | | |
|---|---|---|---|---|
| 5,521,592 | A | 5/1996 | Veneruso | |
| 5,971,072 | A | 10/1999 | Huber et al. | |
| 6,670,880 | B1 | 12/2003 | Hall et al. | |
| 6,768,700 | B1 | 7/2004 | Veneruso et al. | |
| 6,816,082 | B1 | 11/2004 | Laborde | |
| 6,831,571 | B1 | 12/2004 | Bartel | |
| 2002/0075114 | A1 | 6/2002 | Hall et al. | |
| 2002/0112852 | A1 | 8/2002 | Floerke et al. | |
| 2002/0126021 | A1 | 9/2002 | Vinegar et al. | |
| 2003/0029641 | A1 | 2/2003 | Meehan | |
| 2003/0137430 | A1 | 7/2003 | Chalitsios et al. | |
| 2004/0217880 | A1 | 11/2004 | Clark et al. | |
| 2005/0000733 | A1 * | 1/2005 | Schaaf | 175/61 |

FOREIGN PATENT DOCUMENTS

| | | | |
|---|---|---|---|
| EP | 1 158 138 | | 11/2001 |
| GB | 2407334 | * | 4/2005 |
| RU | 2040691 C1 | | 2/1992 |
| RU | 2140537 | | 12/1997 |
| WO | WO 90/14497 | | 11/1990 |
| WO | WO 00/29717 | * | 5/2000 |

OTHER PUBLICATIONS

Michael J. Jellison et al., "Telemetry Drill Pipe: Enabling Technology for the Downhole Internet," *SPE/IADC 79885*, SPE/IADC Drilling Conf., Amsterdam, The Netherlands (Feb. 19-21, 2003).

"IntelliServ" Technology Summary brochure, *Novatek*, Feb. 25, 2003.

Hall, David R. "Telemetry Drill Pipe," *Novatek*, (No date available) pp. 1-2.

http://www.netl.doe.gov/publications/press/1999/tl%5Fsmartdrill.html US Dept of Energy Press Release, Oct. 13, 1999, "DOE Selects California Small Business to Help Develop 'Smart Drilling System' for Oil & Natural Gas".

* cited by examiner

FIG.6
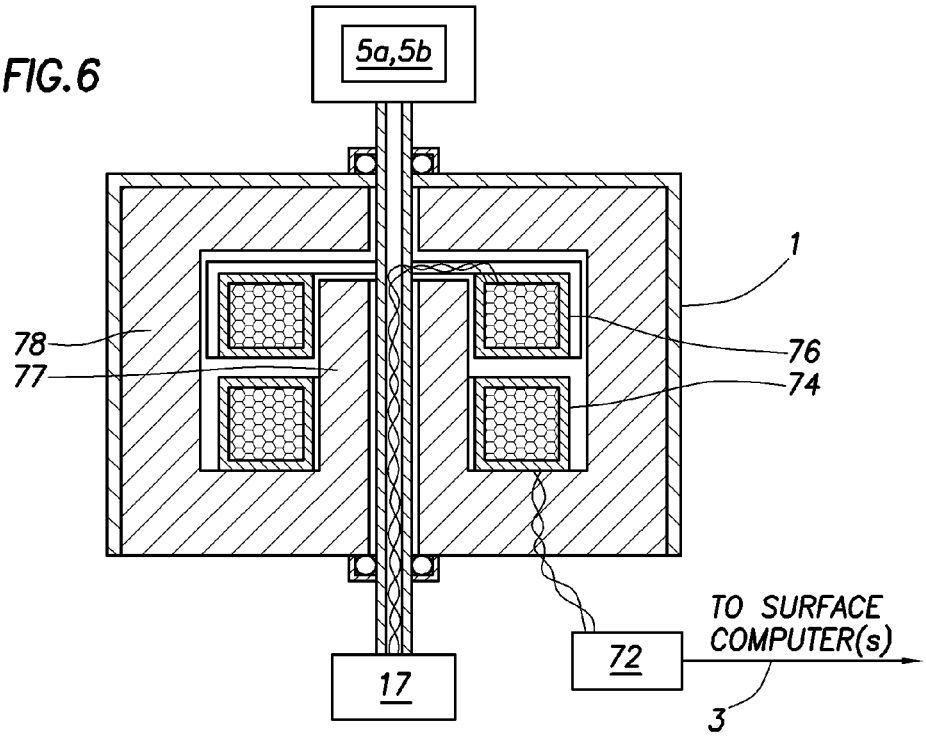
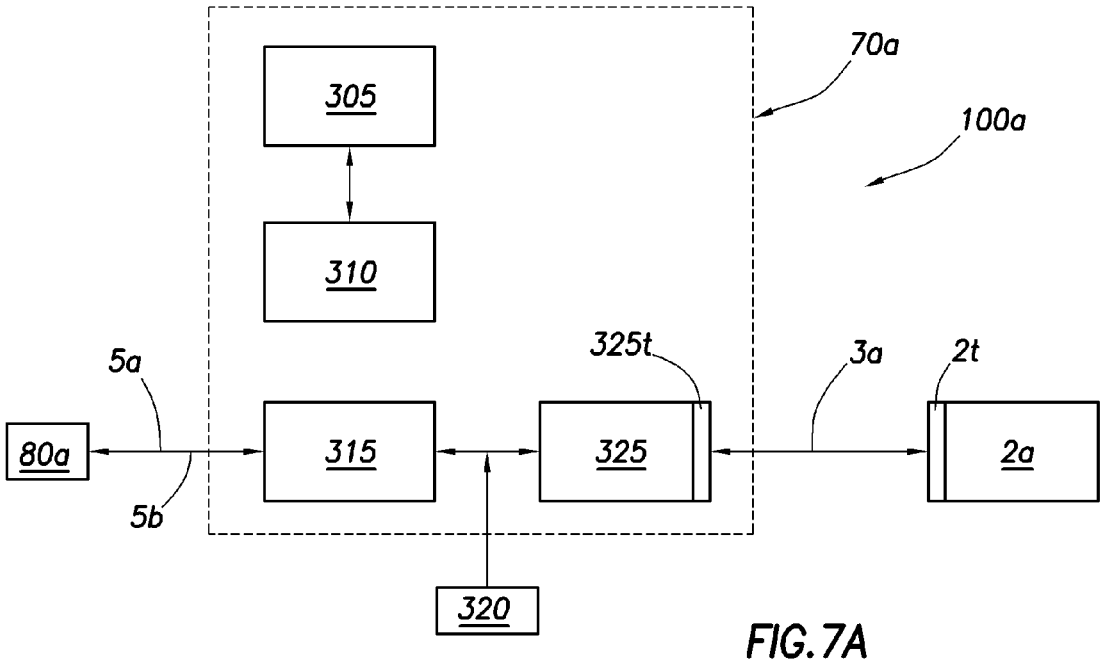
FIG.7A

DOWNHOLE TELEMETRY SYSTEM AND METHOD

CROSS REFERENCE TO RELATED APPLICATIONS

This application is related to U.S. patent application Ser. No. 10/160,311 filed on May 31, 2003, which claims priority to U.S. patent application Ser. No. 09/881,333 filed on Jun. 14, 2001, which in turn claims priority to U.S. Provisional Patent Application Ser. No. 60/278,090 filed on Mar. 23, 2001.

BACKGROUND OF INVENTION

1. Field of the Invention

The present invention relates generally to drill string telemetry. More specifically, the invention relates to wired drill pipe telemetry systems and techniques for transmitting signals through a drillstring.

2. Related Art

Downhole systems, such as Measurement While Drilling (MWD) and Logging While Drilling (LWD) systems, derive much of their value from their abilities to provide real-time information about borehole conditions and/or sub-surface formation properties. These downhole measurements may be used to make decisions during the drilling process or to take advantage of sophisticated drilling techniques, such as geosteering. These techniques rely heavily on instantaneous knowledge of the wellbore and surrounding formation that is being drilled. Therefore, it is important to be able to send large amounts of data from the MWD/LWD tool to the surface and to send commands from the MWD/LWD tools to the surface with a minimum time delay. A number of telemetry techniques have been developed for such communications, including wired drill pipe (WDP) telemetry.

The concept of placing a conductive wire in a drill string has been around for some time. For example, U.S. Pat. No. 4,126,848 issued to Denison discloses a drill string telemeter system, wherein a wireline is used to transmit the information from the bottom of the borehole to an intermediate position in the drill string, and a special drilling string, having an insulated electrical conductor and employing ring-shaped electrical contact connectors, as described in U.S. Pat. No. 3,696,332 issued to Dickson, Jr. et al., is used to transmit the information from the intermediate position to the surface. Russian Federation Patent No. RU 2,140,537C1 to Basarygin et al. similarly discloses a hybrid telemetry drill string system having a lower wireline system serially connected to an upper WDP system.

U.S. Pat. No. 3,957,118 issued to Barry et al. discloses a releasable cable and latch system for drill string telemetry in drill pipe joints that are not otherwise wired. U.S. Pat. No. 3,807,502 issued to Heilhecker et al., and U.S. Pat. Nos. 4,806,928 and 4,901,069 to Veneruso similarly disclose methods and apparatus for installing an electrical conductor (i.e., a cable) in a drill string having conventional, non-wired drill pipe.

U.S. Pat. No. 2,379,800 to Hare, European Patent Application No. 399,987 to Wellhausen, and Russian Federation Patent No. 2,040,691 to Konovalov et al. all describe signal transmission systems that employ inductive couplings with WDP. International Patent Application No. WO 02/06716 to Hall et al. also discloses a system for transmitting data through a string of WDP joints using inductive couplers.

For downhole drilling operations, a large number of drill pipe joints are used to form a chain between the surface kelly joint (or, alternatively, the power swivel in top-drive drilling) and a drill bit. This chain of drill pipe joints substantially makes up the body of a drill string (although a drill string includes other components such as MWD tools, LWD tools, drill collars, stabilizers, bent sub, mud motor, bit box, and drill bit). A 15,000 ft (5472 m) well will typically have 500 drill pipe joints each having a length of 30 ft (9.14 m). In WDP operations, some or all of the drill pipe joints may be provided especially by embedding within their walls with conductive wires to form wired drill pipe ("WDP") joints that are interconnected to provide a communication link between the surface and the drilling tool. With 500 drill pipe joints, also known simply as "pipes" or "tubes," there are 1000 pipe ends/shoulders to be "made up" or connected by threaded rotation to other pipe joints, tubes, subs, etc. (collectively, "tubular members"). Each of these pipe ends may include communication couplers such as inductive couplers, particularly toroidal transformers.

The sheer number of connections in a drill string raises concerns of reliability for a WDP system. A commercial drilling system is expected to have a minimum mean time between system failures (MTBF) of about 500 hours or more. If one of the wired connections in a WDP system fails, then that communication link fails, whereby the entire telemetry system fails. Therefore, where there are 500 WDP joints in a 15,000 ft (5472 m) well, each WDP should have an MTBF of at least about 250,000 hr (28.5 yr) in order for the entire system to have an MTBF of 500 hr. This means that each WDP joint should have a failure rate of less than $4\times10^{-6}$ per hr. This requirement is beyond the current WDP technology. Therefore, it is desirable, if not essential, to preemptively address the probability of failures in a WDP system.

Accordingly, it is desirable to possess a telemetry system capable of bypassing WDP-related failures.

It is further desirable to possess a telemetry system that employs WDP technology to advantage, in cooperation with non-wired drill string sections (e.g., non-wired drill pipe), particularly when such non-wired drill string section(s) are already in use.

It is further desirable to have a telemetry system capable of wireless communication at or near the surface to decrease the reliance upon wired systems in the upper portion of the drill string.

SUMMARY OF INVENTION

Certain terms are defined throughout this description as they are first used, while certain other terms used in this description are defined below:

- "communicative" means capable of conducting or carrying a signal;
- "communicative connection" means a connection between two adjacent tubular members, such as adjacent pipe joints, through which a signal may be conducted;
- "communication link" means a plurality of communicatively-connected tubular members, such as interconnected WDP joints or adapter subs connected by a cable, for conducting a signal over a distance ("communication link" and "communication channel" are used synonymously herein);
- "surface computer" means a computer, surface transceiver, and/or other components for processing data conveyed by way of signals;
- "telemetry system" means at least one communication link plus other components such as a surface computer, MWD/LWD tools, communication subs, and/or routers, required for the measurement, transmission, and indication/recordation of data acquired from or through a wellbore.

In one aspect, the present invention provides a cabled communication link for a drill string, and includes at least two adapter subs spaced apart within the drill string by a distance that exceeds the length of the three interconnected drill pipe joints. A cable connects the two adapter subs for communication of a signal therebetween.

In a preferred embodiment, each of the adapter subs of the cabled communication link includes a communicative coupler intermediate its ends, and an inner annular recess spaced a predetermined axial distance from the communicative coupler. The cable carries a pair of sub connectors that are connected in series along the cable. Each of the sub connectors has a complementing communicative coupler, whereby alignment of a sub connector's complementing communicative coupler with the communicative coupler of an adapter sub establishes communication between the adapter sub and sub connector. The communicative couplers and complementing communicative couplers are preferably inductive couplers. The second of the pair of sub connectors similarly engages a second adapter sub. In this manner, a signal may be transmitted between the cable and the drill string.

Each of the adapter subs preferably includes an inner annular recess spaced a predetermined axial distance from the communicative coupler. Each of the sub connectors preferably has a latch for engaging the inner annular recess of one of the adapter subs and positioning its complementing communicative coupler in alignment with the communicative coupler of the one adapter sub.

It is further preferred that the latch of each of the sub connectors includes a locking dog having at least one key for engaging the inner annular recess of one of the adapter subs. The key is spaced from the complementing communicative coupler of each sub connector by the predetermined axial distance. Thus, engagement by the key with the annular recess of one of the adapter subs when the cable is disposed within the drill string aligns the sub connector's complementing communicative coupler with the communicative coupler of the one adaptor sub and establishes communication therebetween. The locking dog preferably includes a detent latch.

The inventive cabled communication link may be applied to advantage in a drill string wherein a plurality of WDP joints are interconnected within the drill string between the two adapter subs to form a piped communication link. In this application, the cabled communication link establishes an alternative pathway to the piped communication link for transmitting a signal through the drill string, whereby a failure in the piped communication system (i.e., the WDP system) may be bypassed.

The cabled communication link may also be used to advantage in a drill string wherein a non-wired section of the drill string is disposed between the two adapter subs. In this manner, the cabled communication link establishes a pathway for transmitting a signal through the non-wired section of the drill string, whereby the non-wired section is converted to a cabled section. The non-wired section of the drill string may include one or more non-wired drill pipe joints or one or more non-wired utility subs.

In another aspect, the present invention provides a telemetry system for a drill string disposed within a wellbore and having a plurality of WDP joints that form a first communication link. Each of the WDP joints has a communicative first coupler at or near each end thereof, and a first cable connecting the communicative first couplers. The drill string further includes a pair of adapter subs spaced apart within the drill string by a distance that exceeds the length of three interconnected drill pipe joints. Each of the adapter subs has a communicative second coupler at or near at least one of the adapter sub's ends, and is adapted for connection to a second cable disposed in the drill string such that a second cable connects the pair of adapter subs to form a second communication link. At least one of the adapter subs is connected in the drill string such that its communicative second coupler is adjacent a communicative first coupler of one of the WDP joints to couple the one adapter sub to the one WDP joint for communication therebetween. In this manner, the first communication link may be coupled for communication with a second communication link to transmit signals through the drill string.

In one embodiment of the inventive telemetry system, the one adapter sub is connected between two of the WDP joints within the drill string, whereby a portion of the first communication link may be bypassed by a second communication link. Alternatively, the one adapter sub may be connected between the one WDP joint and a non-wired section of the drill string, whereby the non-wired section of the drill string may be converted to a cabled section by a second communication link. In the alternative embodiment, the non-wired section of the drill string may include one or more non-wired drill pipe joints and/or non-wired utility subs.

It is preferred that the communicative first couplers of the WDP joints and the communicative second couplers of the adapter subs are inductive couplers.

A preferred embodiment of inventive telemetry system contemplates, and is adapted for use with, a second cable disposed within the drill string for connecting the pair of adapter subs to form a second communication link coupled for communication with the first communication link. For this purpose, each of the adapter subs includes a communicative third coupler intermediate the communicative second couplers, and an inner annular recess spaced a predetermined axial distance from the communicative third coupler. The second cable has a pair of sub connectors carried in series thereby, and each of the sub connectors has a communicative fourth coupler, whereby alignment of the sub connector's communicative fourth coupler with the communicative third coupler of the one adapter sub establishes communication between the first communication link and the second communication link. In this manner, a signal may be transmitted between the second cable and the drill string. The communicative third couplers and communicative fourth couplers are preferably inductive couplers.

Each of the adapter subs preferably includes an inner annular recess spaced a predetermined axial distance from the communicative third coupler. Each of the sub connectors preferably has a latch for engaging the inner annular recess of an adapter sub and positioning its communicative fourth coupler in alignment with the communicative third coupler of the engaged adapter sub.

It is further preferred that the latch of each of the sub connectors includes a locking dog having at least one key for engaging the inner annular recess of one of the adapter subs. The key is spaced from the communicative fourth coupler of each sub connector by the predetermined axial distance. Thus, engagement by the key with the annular recess of an adapter sub when the cable is disposed within the drill string aligns the sub connector's communicative fourth coupler with the communicative third coupler of the engaged adaptor sub and establishes communication therebetween. The locking dog may include a detent latch.

The inventive telemetry system contemplates the use of a plurality of adapter subs (i.e., not merely two) spaced apart within the drill string by a distance that exceeds the length of three interconnected drill pipe joints. Each of the adapter subs is adapted for connecting to and includes in a preferred embodiment a second cable disposed within the drill string such that a second cable can connect at least two of adapter subs to form a second communication link. At least one of the adapter subs is connected in the drill string such that its communicative second coupler is adjacent a communicative first coupler of one of the WDP joints to couple the one adapter sub to the one WDP joint for communication therebetween. The first communication link may therefore be coupled for communication with a second communication link.

In a preferred embodiment, the inventive telemetry system further includes a measurement tool disposed in a lower section of the drill string, a surface computer for processing data acquired by the measurement tool, a first communication sub disposed in or above an upper section of the drill string for communicating with the surface computer, and a second communication sub disposed in the lower section of the drill string for communicating with the measurement tool. The first communication link provides at least a portion of an operative communicative connection between the downhole communication sub and the surface communication sub. A second cable may be disposed within the drill string and connected across the pair of adapter subs, thereby forming a second communication link connected for communication with the first communication link. The second communication link also provides at least a portion of an operative communicative connection between the second communication sub and the first communication sub.

This embodiment contemplates that the measurement tool, e.g., an MWD/LWD tool, may also serve as an adapter sub.

In various embodiments of the telemetry system, the first communication sub is disposed: beneath a kelly joint in the (rotary table-driven) drill string; above a kelly joint in the (rotary table-driven) drill string; beneath a power swivel supporting the (top-driven) drill string; or within a power swivel supporting the (top-driven) drill string. If disposed above a kelly joint in the drill string, the first communication sub may include a rotary transformer or a slip ring. The first communication sub may also include, in various applications, a first wireless transceiver in wired communication with the first communication link. The first wireless transceiver is preferably complemented by a second wireless transceiver in wired communication with the surface computer, and the first and second wireless transceivers are adapted for wireless communication therebetween. The second wireless transceiver may be disposed in a mud return line connected between a mud pit and the wellbore.

In another aspect, the first communication sub of the inventive telemetry system includes a WDP modem in wired communication with the first communication link, a wireless modem in wired communication with the WDP modem, and a power supply powering the modems. The power supply may include one or more batteries.

In yet another aspect, the present invention provides a telemetry system for a drill string having a plurality of interconnected drill pipe joints suspended by a derrick and engaged by a torque-applying mechanism for rotation thereof. A measurement tool is suspended by the drill pipe joints for acquiring wellbore data, a downhole communication sub is suspended by the drill pipe joints for communicating with the measurement tool via the drill pipe joints, and a drill bit defines the lower end of the drill string. The system includes a surface computer for processing data acquired by the measurement tool, and a surface communication sub disposed in the drill string beneath a portion of the drill string engaged by the torque-applying mechanism for wirelessly-communicating with the surface computer. The surface communication sub communicates with the downhole communication sub (at least partially) via the drill pipe joints.

In a preferred embodiment according to this aspect of the present invention, the surface communication sub includes a first wireless transceiver, and the telemetry system further includes a second wireless transceiver disposed in a mud return line connected between a mud pit and the wellbore. The second wireless transceiver is in wired communication with the surface computer. The downhole communication sub may communicate with the surface communication sub in a number of ways, including mud-pulse telemetry, electromagnetic telemetry, pipe acoustic telemetry, and wired links. One example of such a wired link is embodied by using sequentially-connected WDP joints for at least some of the drill pipe joints, the WDP joints having a first communication link therethrough providing at least a portion of an operative communicative connection between the downhole communication sub and the surface communication sub.

In a particular embodiment, the inventive telemetry system further includes a means for forming a second communication link coupled for communication with the first communication link. In this embodiment, each of the WDP joints has communicative first couplers at or near both ends thereof, and a first cable connecting the communicative first couplers. The second communication link-forming means preferably includes a pair of adapter subs spaced apart within the drill string by a distance that exceeds the length of three interconnected drill pipe joints. Each of the adapter subs has a communicative second coupler at or near at least one of its ends. The adapter subs are adapted for connection to a second cable disposed within the drill string which the invention also contemplates such that a second cable connects the pair of adapter subs to form a second communication link. At least one of the adapter subs is connected in the drill string such that its communicative second coupler is adjacent a communicative first coupler of one of the WDP joints to couple the one adapter sub to the one WDP joint for communication therebetween. In this manner, the first communication link may be coupled for communication with a second communication link to transmit signals through the drill string.

This embodiment also contemplates that the measurement tool, e.g., an MWD/LWD tool, may also serve as an adapter sub.

It is further preferred in this aspect of the invention that each of the adapter subs includes a communicative third coupler intermediate the communicative second couplers. The second cable has a pair of sub connectors carried in series thereby. Each of the sub connectors has a communicative fourth coupler, whereby alignment of the sub connector's communicative fourth coupler with the communicative third coupler of an adapter sub establishes communication therebetween.

In a still further aspect, the present invention provides a downhole drilling method that includes the steps of drilling a wellbore with a drill string, acquiring wellbore data while drilling with a measurement tool disposed in the drill string, and transmitting the acquired wellbore data to the surface of the wellbore via a communication link defined by at least two adapter subs spaced apart within the drill string by a distance that exceeds the length of three interconnected drill pipe joints. A cable connects the adapter subs for transmitting signals between the adapter subs.

In a particular embodiment, the inventive downhole drilling method further includes the step of transmitting the acquired wellbore data to the surface of the wellbore via another communication link defined by a plurality of interconnected WDP joints, and the step of transmitting the acquired wellbore data to the surface of the wellbore via a third communication link defined by a surface communication sub wired for communication to the interconnected WDP joints. The surface communication sub transmits the acquired wellbore data from the interconnected WDP joints to a surface computer for processing, and may use one or more wireless transceivers for this purpose.

In a still further aspect, the present invention relates to a downhole drilling method that includes the steps of drilling a wellbore with a drill string, acquiring wellbore data while drilling with a measurement tool disposed in the drill string, and transmitting the acquired wellbore data to the surface of the wellbore via a first communication link defined by a plurality of WDP joints and a second communication link defined by at least a pair of spaced apart adapter subs connected by a second cable for communication of signals between the pair of adapter subs.

In a particular embodiment of this drilling method, the transmitting step includes using the second communication link to bypass a portion of the first communication link. Alternatively, the step of transmitting may include using the second communication link to convert a non-wired section of the drill string into a cabled section.

In yet a further aspect, the invention provides a downhole drilling method that includes the step of drilling a wellbore with a drill string having a plurality of adapter subs disposed therein. Successive adapter subs within the drill string are separated by at least four interconnected wired drill pipe joints. The adapter subs and wired drill pipe joints together define a first communication link. Wellbore data is acquired while drilling with a measurement tool disposed in the drill string, and the acquired wellbore data is transmitted to the surface of the wellbore via the first communication link. Upon detecting the presence of a fault in the first communication link, a cable is disposed within the drill string for establishing a second communication link. The cable has a pair of spaced sub connectors connected in series along the cable for establishing communication with a respective pair of consecutive adapter subs, whereby the second communication link is established by such communication. The second communication link bypasses the interconnected wired drill pipe joints between the pair of consecutive adapter subs.

In a preferred embodiment of the invention according to this method, a determination is made whether the fault lies within the portion of the drill string between the pair of consecutive adapter subs. Upon determining that the fault does not lie within the portion of the drill string between the pair of consecutive adapter subs, the cable is moved within the drill string to establish communication between the pair of sub connectors and other respective pairs of consecutive adapter subs until the location of the fault is identified. Once the fault is identified, it may be cured, e.g., by replacing defective joints of wired drill pipe during a trip of the drill string.

Other aspects of the invention will become apparent from the following description, the drawings, and the claims.

BRIEF DESCRIPTION OF DRAWINGS

FIG. 6 is a sectional view of an inductive rotary coupling having application in a telemetry system according to one aspect of the present invention;

FIG. 7A is a schematic representation of a surface communication link according to one aspect of the present invention;

DETAILED DESCRIPTION

Figure 1A:
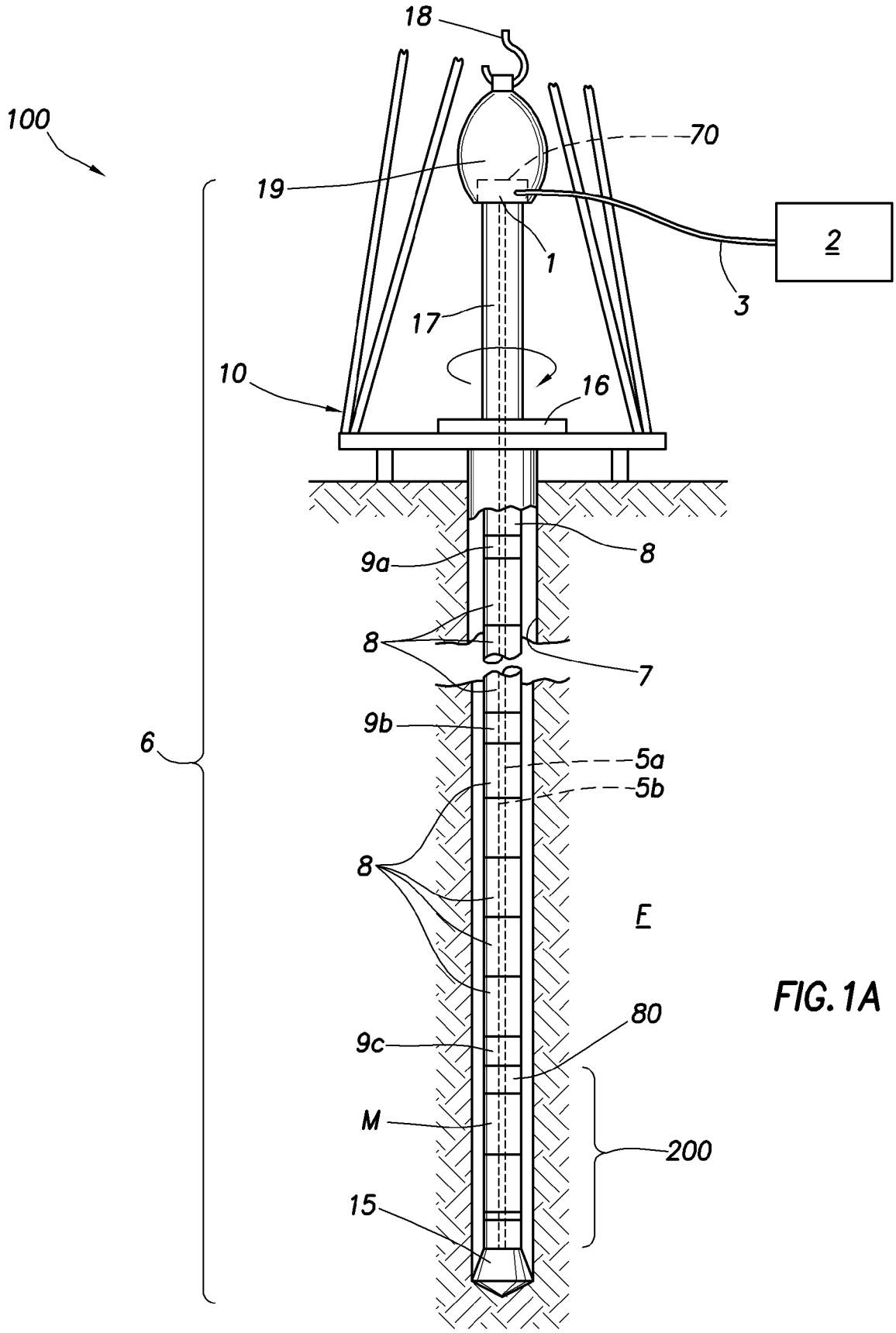
FIG. 1A is an elevational representation of a drill string having a telemetry system that includes a piped communication link and a cabled communication link in accordance with one aspect of the present invention.

FIG. 1A depicts a drill string 6 that employs a telemetry system 100 in accordance with one aspect of the present invention. The drill string 6 includes a plurality of interconnected tubular members (described further below) suspended from a derrick and platform assembly 10 by way of a traveling block (not shown) and a hook 18. The upper end of the drill string 6 is defined by a kelly joint 17, the uppermost tubular member in the string, which is engaged by a conventional torque-applying means including a rotary table 16 for rotating the kelly joint as well as the entire drill string 6. A swivel 19 connects the hook 18 to the kelly joint 17, and permits rotation of the kelly joint and the drill string 6 relative to the hook.

The lower end of the drill string is defined by a drill bit 15 which drills through the formation F to create a wellbore 7. The drill bit is connected for rotation with the drill string 6 in a rotary drilling configuration of the sort described above.

The drill string 6 may otherwise employ a "top-drive" configuration (also well known) wherein a power swivel rotates the drill string instead of a kelly joint and rotary table. Those skilled in the art will also appreciate that "sliding" drilling operations may otherwise be conducted with the use of a well known Moineau-type mud motor that converts hydraulic energy from the drilling mud pumped from a mud pit down through the drill string 6 into torque for rotating a drill bit. Drilling may furthermore be conducted with so-called "rotary-steerable" systems which are known in the related art. The various aspects of the present invention are adapted to each of these configurations and are not limited to conventional rotary drilling operations, although such equipment and methods will be described herein for illustrative purposes.

With reference now to FIGS. 1A–1C and 2A, the drill string telemetry system 100 includes a cabled communication link 5*b* having at least two spaced apart adapter subs (e.g., 9*a*, 9*b*, 9*c*) within the drill string and a cable 112 connecting the two adapter subs 9*a*, 9*b* for communication of a signal therebetween. As shown particularly in FIGS. 2A–2B, each of the adapter subs (indicated simply as 9) of the cabled communication link 5*b* includes a communicative coupler 114 intermediate its ends, and an inner annular recess 116 spaced a predetermined axial distance d1 from the communicative coupler 114. The communicative coupler 114 is wired for communication through a cable 115, permitting the adapter sub 9 to also serve as a component in a piped communication link 5*a* (described further below).

The cable 112 includes a load-bearing, protective skin 113 and at least a pair of wires 112*a*, 112*b* along its length. The cable 112 also carries, by way of mechanical and communicative connection, a pair of generally cylindrical sub connectors 118 that are spaced apart and connected to each other in series via the cable skin 13 and communicative wires 112*a*, 112*b*. Each of the sub connectors 118 has a complementing communicative coupler 120 connected by the cable wires 112*a*, 12*b*, and a locking dog 122 having at least one key 124 biased outwardly by a coil spring 126 for engaging the annular recess 116 of one of the adapter subs 9. Those skilled in the art will appreciate that other known mechanical means for positively engaging a cable-conveyed tool to a tubular member in a drill string may be used to advantage, such as the detent latch mechanism disclosed in U.S. Pat. No. 5,971,072 to Huber et al., the keyed anchoring system disclosed in U.S. Pat. No. 4,901,069 to Veneruso, as well as other known latching means (e.g., frictional brake/lock, roller brake, magnetic lock).

The locking dog preferably uses a "detent" latch that permits engagement and disengagement by the application of a predetermined force. In the case of engagement, the requisite force is applied by the weight of the cable 112 and sub connector(s) 118. For disengagement, the requisite force is applied by tension in the cable 112 from a wireline unit mounted on a truck, trailer, or platform at the surface.

The key 124 is spaced along the sub connector 118 from the complementing communicative coupler 120 by the predetermined axial distance d1. In this configuration, when the cable 112 is disposed within the drill string to lower one or more sub connectors 118 within adapter subs 9, engagement by the key 124 of one of the sub connectors 118 with the annular recess 116 of one of the adapter subs 9 vertically aligns the sub connector's complementing communicative coupler 120 with the communicative coupler 114 of the one adapter sub 9 to establish communication between the one adapter sub 9 and the sub connector 118. In this manner, a signal may be transmitted between the cable 112 and the drill string 6 containing the adapter sub 9. The communicative coupler 114 and complementing communicative coupler 120 are preferably inductive couplers, as are known in the art (see also the related description below).

Those skilled in the art and given the benefit of this disclosure will appreciate that effective communication may also be established by passive positioning using only the cable 112. In other words, the use of positive latching means for positioning the sub connector 118 within the adapter sub 9 is not an essential feature of the present invention, although such means are presently preferred.

Figure 2A:
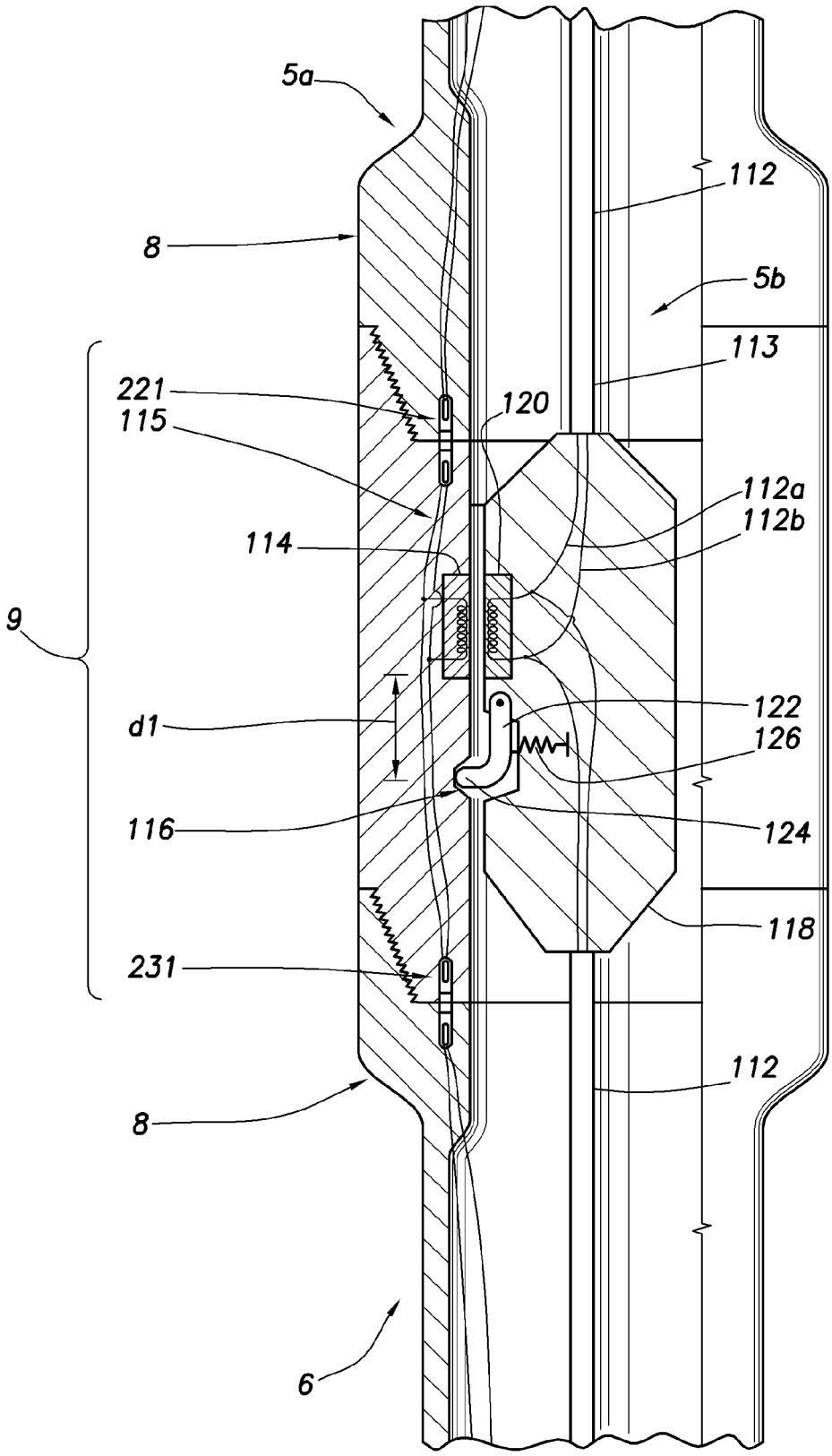
FIG. 2A is an elevational view, partially in section, of a cable-conveyed connector sub engaging an adapter sub to enable a cabled communication link according to one aspect of the present invention.
Figure 2B:
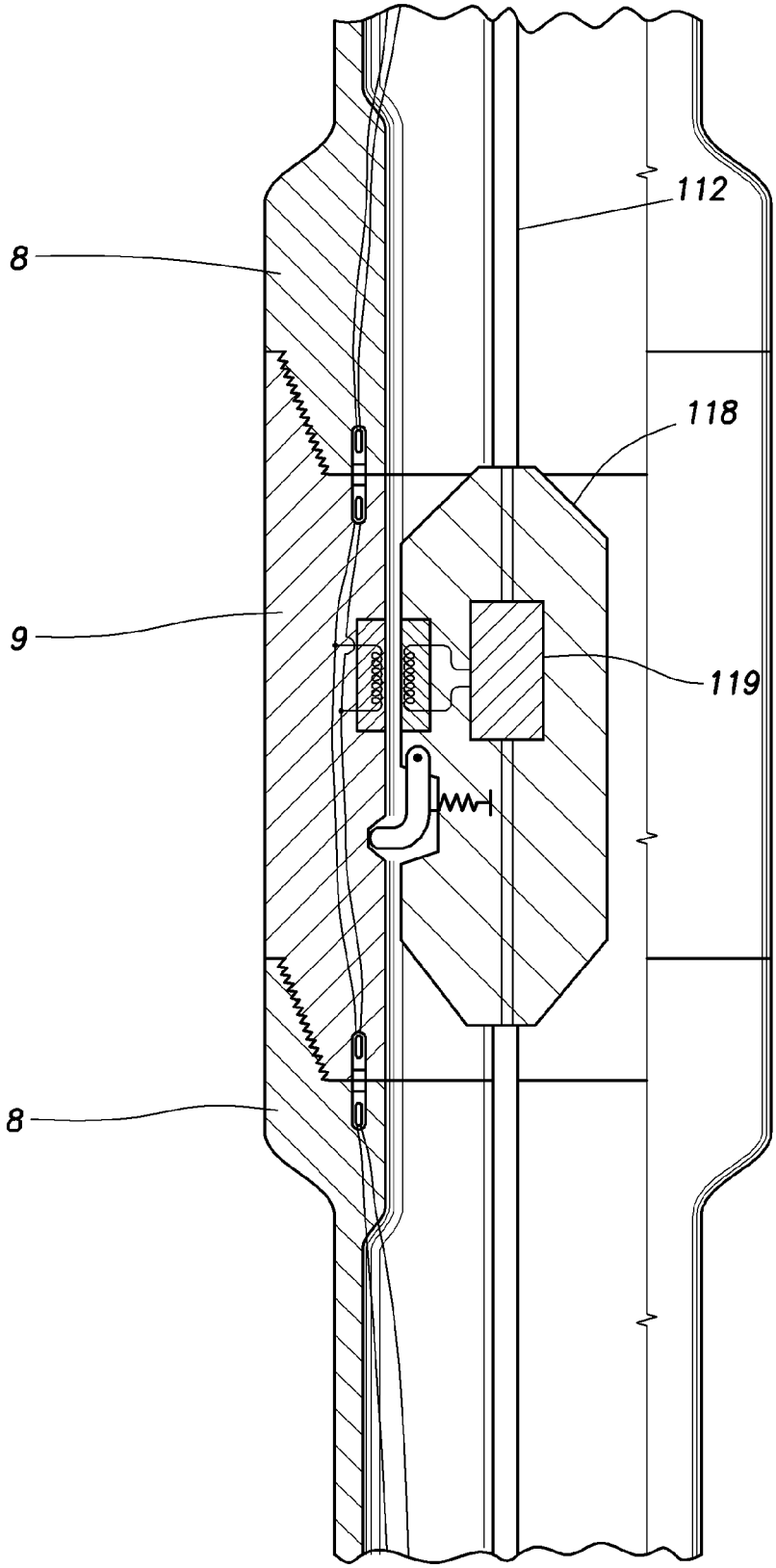
FIG. 2B is a similar view to that of FIG. 2A, except the connector sub is equipped with electronics for performing a function in the wellbore, such as signal modulation.

FIG. 2B illustrates the connector sub 118 being equipped with an electronics package 119 for performing one or more functions such as switching, signal amplification, impedance matching, or signal modulation/demodulation.

Figure 1B:
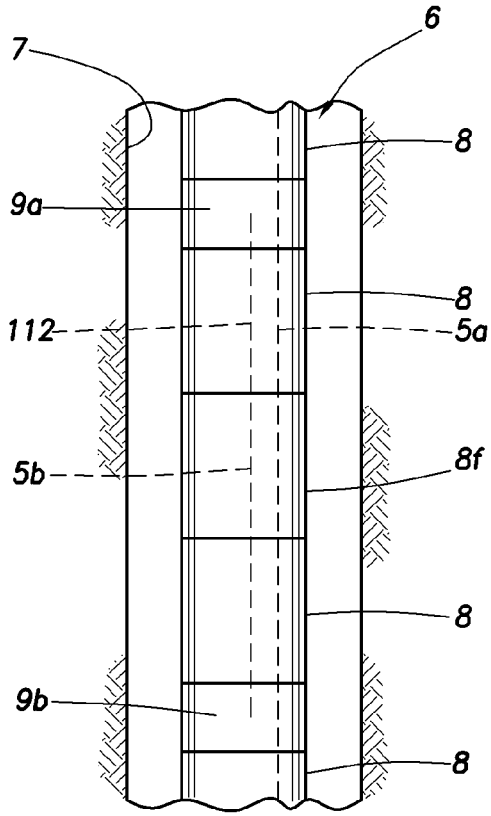
FIG. 1B shows a detailed portion of the drill string of FIG. 1, illustrating in particular the use of the cabled communication link as a bypass for a failure in the piped communication link.

With particular reference now to FIG. 1B, the cabled communication link 5*b* may be applied to advantage in a drill string 6 wherein a plurality of WDP joints 8 are interconnected within the drill string between two adapter subs 9*a*, 9*b* to form a piped communication link 5*a*. In this application, the cabled communication link 5*b* establishes an alternative pathway to the piped communication link 5*a* for transmitting a signal through the drill string 6. Thus, when a failure in the piped communication system (i.e., the WDP system) occurs at WDP joint 8*f*, drill string telemetry is maintained by establishing the cabled communication link 5*b* as described herein.

Figure 1C:
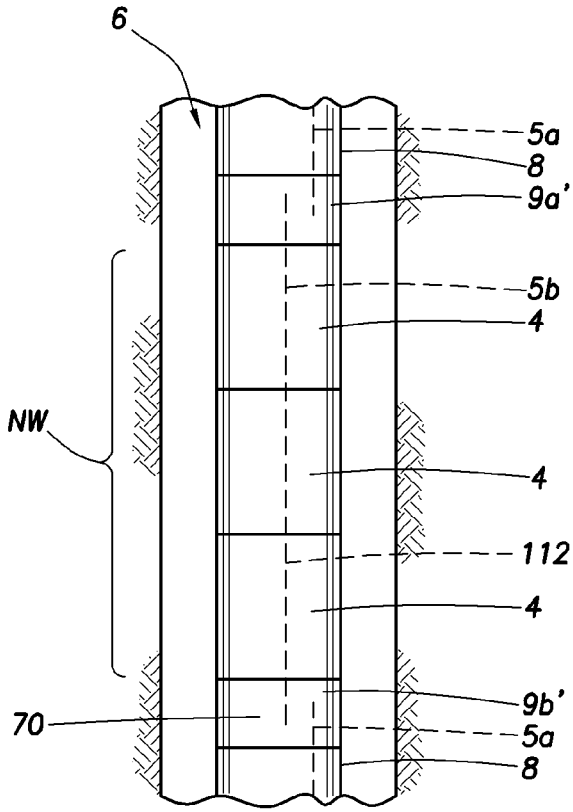
FIG. 1C shows a detailed portion of an alternative drill string configuration, illustrating in particular the use of the cabled communication link for converting a non-wired section of the drill string to a cabled section for communicating signals therealong.

FIG. 1C demonstrates the cabled communication link 5*b* being used to advantage in a drill string wherein a non-wired section NW of the drill string 6 is disposed between the two adapter subs 9*a*", 9*b*". In this manner, the cabled communication link 5*b* establishes a pathway for transmitting a signal through the non-wired section NW of the drill string, whereby the non-wired section is converted to a cabled section. The non-wired section of the drill string may include one or more standard (i.e., non-wired) drill pipe joints 4 or, alternatively, one or more non-wired utility subs such as drill collars, stabilizers, jars, bent subs, etc. In this sense, the cabled communication link (also referred to herein as a second communication link) establishes a so-called "hybrid" telemetry system.

The piped communication link (also referred to herein as a first communication link) 5*a* established by the plurality of wired drill pipe (WDP) joints will now be described in greater detail. One type of WDP joint, as disclosed in U.S. patent application Ser. No. 2002/0193004 by Boyle et al. and assigned to the assignee of the present invention, uses communicative first couplers preferably inductive couplers to transmit signals across the WDP joints. An inductive coupler in the WDP joints, according to Boyle et al., comprises a transformer that has a toroidal core made of a high permeability, low loss material such as Supermalloy (which is a nickel-iron alloy processed for exceptionally high initial permeability and suitable for low level signal transformer applications). A winding, consisting of multiple turns of insulated wire, winds around the toroid core to form a toroid transformer. In one configuration, the toroidal transformer is potted in rubber or other insulating materials, and the assembled transformer is recessed into a groove located in the drill pipe connection.

Figure 5:
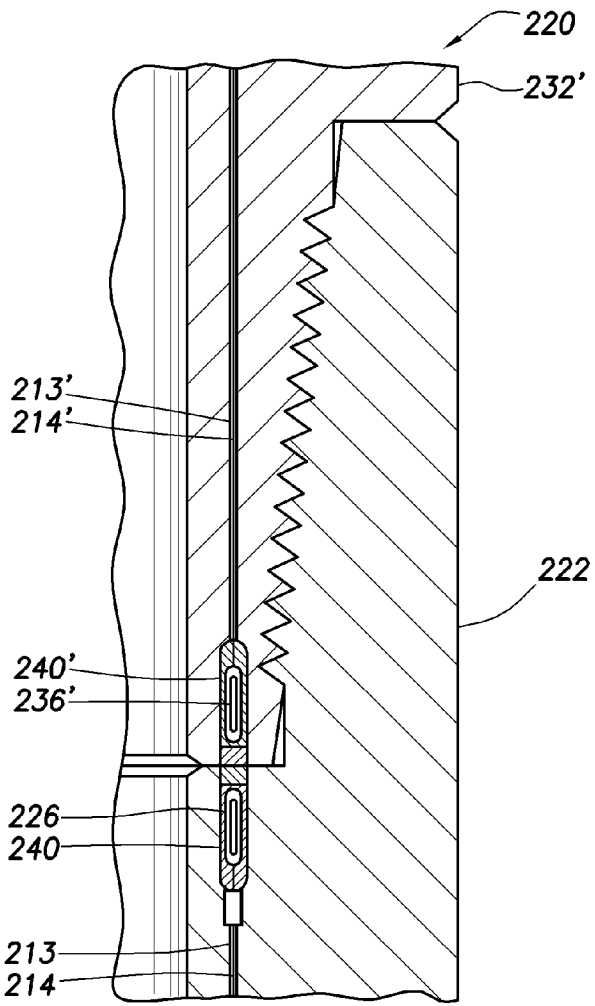
FIG. 5 is a detailed, cross-sectional view of portions of the box end and pin end depicted in FIG. 4 after the two have been made up (i.e., connected) in a drill string.
Figure 3:
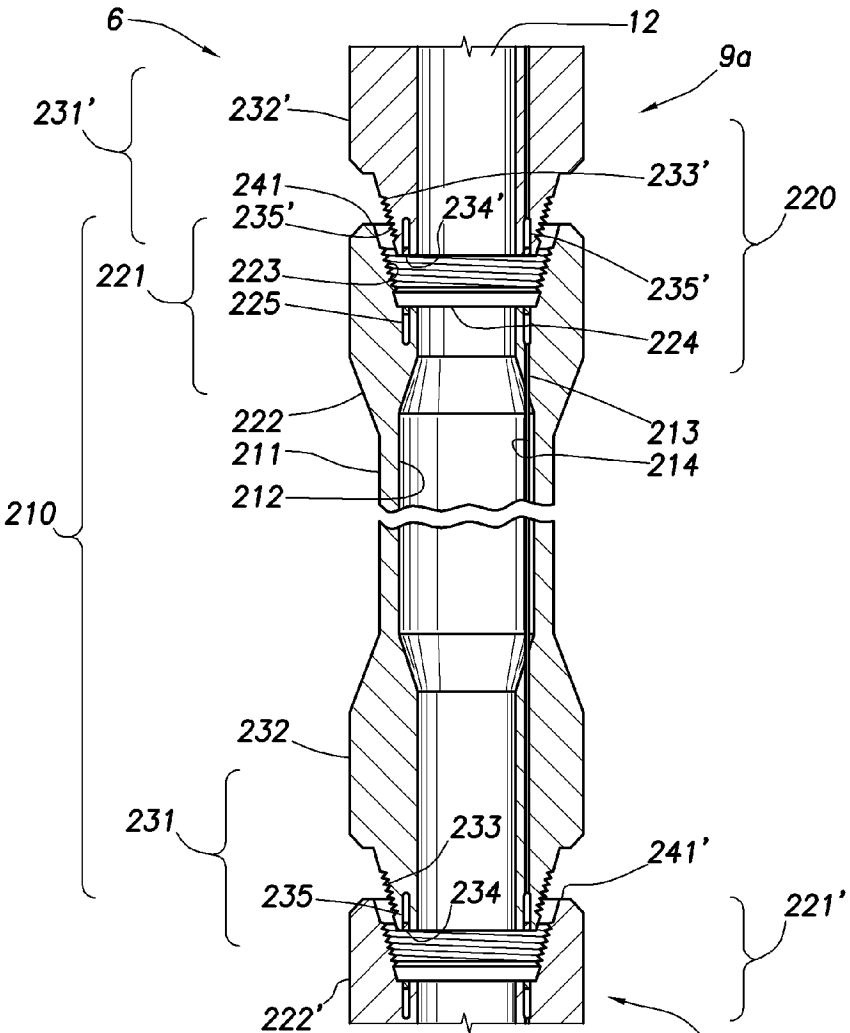
FIG. 3 is a detailed elevational view, in section, of a wired drill pipe (WDP) joint being made up in a drill string.
Figure 4:
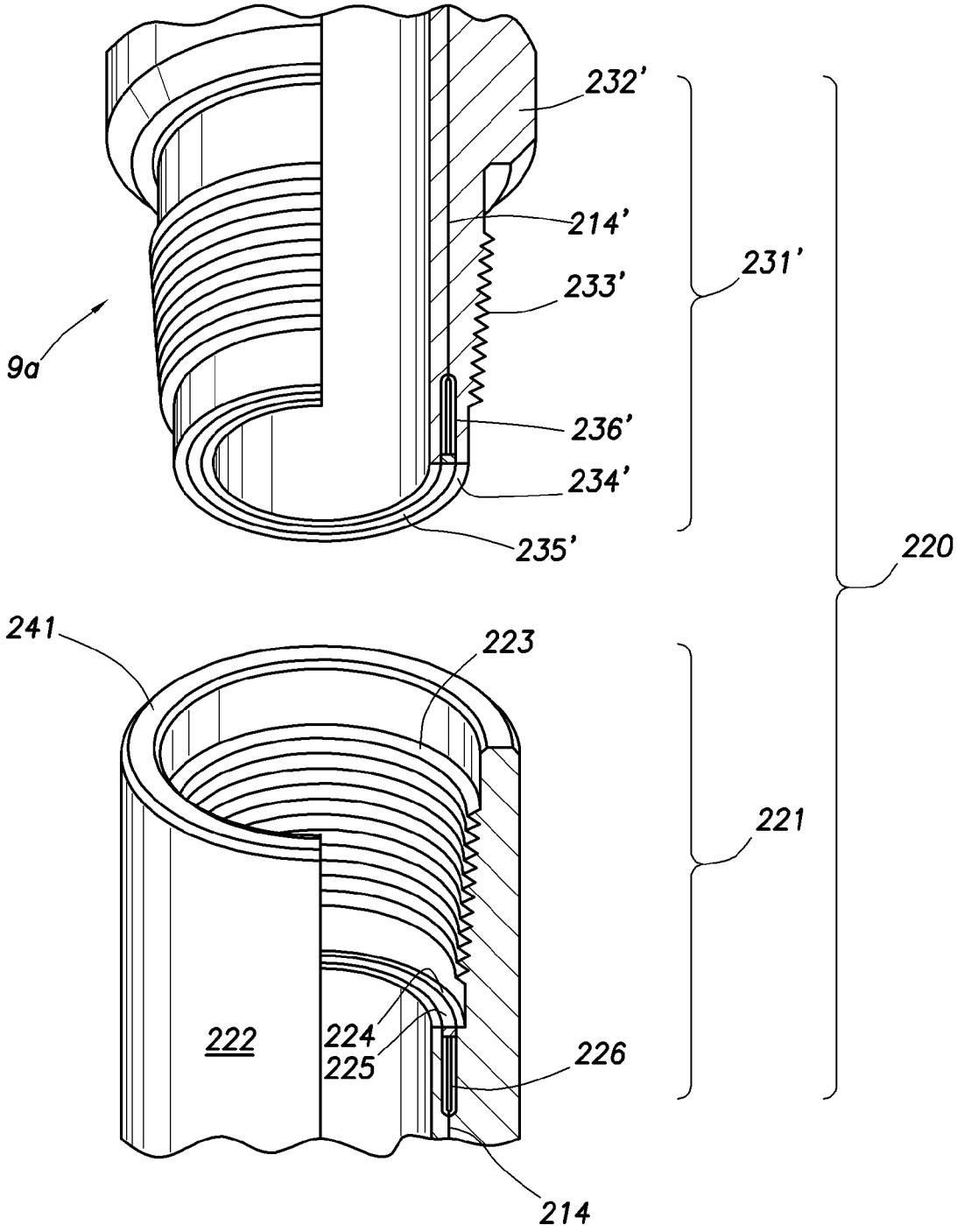
FIG. 4 is a detailed elevational view, in partial section, of a box end of a WDP joint positioned for make-up with a pin end of another tubular member, in accordance with FIG. 3.

Turning now to FIGS. 3–5, a WDP joint 210 is shown to have communicative first couplers 221, 231 at or near the respective end 241 of box end 222 and the end 234 of pin end 232 thereof. A first cable 214 extends through a conduit 213 to connect the communicative first couplers, 221, 231 in a manner that is described further below.

The WDP joint 210 is equipped with an elongated tubular shank 211 having an axial bore 212, a box end 222, a pin end 232, and a first cable 214 running from the box end 222 to the pin end 232. A first current-loop inductive coupler element 221 (e.g., a toroidal transformer) and a similar second current-loop inductive coupler element 231 are disposed at the box end 222 and the pin end 232, respectively. The first current-loop inductive coupler element 221, the second current-loop inductive coupler element 231, and the first cable 214 collectively provide a communicative conduit across the length of each WDP joint. An inductive coupler (or communicative connection) 220 at the coupled interface between two WDP joints is shown as being constituted by a first inductive coupler element 221 from WDP joint 210 and a second current-loop inductive coupler element 231' from the next tubular member (which may be another WDP joint, or an adapter sub 9*a* as described above). Those skilled in the art will recognize that, in some embodiments of the telemetry system 100, the inductive coupler elements may be replaced with other devices serving a similar communicative function, such as, e.g., direct electrical-contact connections of the sort disclosed in U.S. Pat. No. 4,126,848 by Denison.

FIGS. 4 and 5 depict the inductive coupler or communicative connection 220 of FIG. 3 in greater detail. Box end 222 includes internal threads 223 and an annular inner contacting shoulder 224 having a first slot 225, in which a first toroidal transformer 226 is disposed. The toroidal transformer 226 is connected to the cable 214. Similarly, pin-end 232" of an adjacent wired tubular member (e.g., another WDP joint or an adapter sub 9*a*) includes external threads 233" and an annular inner contacting pipe end 234" having a second slot 235", in which a second toroidal transformer 236" is disposed. The second toroidal transformer 236" is connected to a second cable 214" of the adjacent tubular member 9*a*. The slots 225 and 235" may be clad with a high-conductivity, low-permeability material (e.g., copper) to enhance the efficiency of the inductive coupling.

When the box end 222 of one WDP joint is assembled with the pin end 232" of the adjacent tubular member (e.g., another WDP joint or an adapter sub 9*a*), a communicative connection is formed. FIG. 5 shows a cross section of a portion of the resulting interface, in which a facing pair of inductive coupler elements (i.e., toroidal transformers 226, 236") are locked together to form a communicative connection within an operative communication link. This cross section view also shows that the closed toroidal paths 240 and 240" enclose the toroidal transformers 226 and 236", respectively, and conduits 213 and 213" form passages for internal electrical cables 214 and 214" that connect the two inductive coupler elements disposed at the two ends of each WDP joint.

The above-described inductive couplers incorporate an electric coupler made with a dual toroid. The dual-toroid coupler uses inner shoulders of the pin and box ends as electrical contacts. The inner shoulders are brought into engagement under extreme pressure as the pin and box ends are made up, assuring electrical continuity between the pin and the box ends. Currents are induced in the metal of the connection by means of toroidal transformers placed in slots. At a given frequency (for example 100 kHz), these currents are confined to the surface of the slots by skin depth effects. The pin and the box ends constitute the secondary circuits of the respective transformers, and the two secondary circuits are connected back to back via the mating inner shoulder surfaces.

While FIGS. 3–5 depict certain communicative coupler types, it will be appreciated by one of skill in the art that a variety of couplers may be used for communication of a signal across interconnected tubular members. For example, such systems may involve magnetic couplers, such as those described in International Patent Application No. WO 02/06716 to Hall. Other systems and/or couplers are also envisioned.

In FIG. 3, the spacing between adapter subs 9*a*, 9*b* is illustrated as being only one joint of WDP, i.e., 30 feet (9.144 m), for simplicity. Those skilled in the art will appreciate, however, that such spacing will often be defined a plurality of interconnected WDP joints, and, in one embodiment, is presently intended to be approximately 1000 feet (304.8 m) in length. A sting of WDP joints of this length is believed to be operative without the need for repeater or booster subs to enhance the communicated signal(s) over extended distances, but the present invention is well adapted for, and contemplates the use of, such repeaters as needed. The adapter subs are themselves very similar to the WDP joints described herein, except the adapter subs may have a differing lengths than the standard 30 foot (9.144 m) joint length particularly shortened lengths, down to as little as 3 feet (0.914 m) and the adapter subs are adapted for engagement with a second cable 112 as described above with reference to FIGS. 2A and 2B. Furthermore, measurement tools M disposed in the drill string, such as MWD and LWD tools, may be equipped to also function as adapter subs, permitting the direct connection of a cable such as cable 112 (described below) to one or more measurement tools M.

Each of the adapter subs 9*a*, 9*b* in FIG. 3 has a communicative second coupler 231", 221" at or near at least the respective end 234" of pin end 232" and the end 241" of box end 222" thereof. The adapter subs are adapted for connection to a second cable 112 disposed in the drill string 6 such that the second cable 112 connects the pair of adapter subs to form a second communication link 5*b*, as described above. It is intended that the second communication link will only be established as needed, e.g., to "jump" or bypass a failure in the first communication link, or to establish a communication link in a portion of the drill string where none exists.

Thus, in the embodiment of the inventive telemetry system shown in FIGS. 2A–B, the one adapter sub 9 is connected between two of the WDP joints 8 within the drill string 6, whereby a portion of the first communication link 5*a* defined by interconnected WDP joints (and including adapter sub 9) may be bypassed by a second communication link 5*b* defined by cable-wired adapter subs. Alternatively, the one adapter sub 9 may be connected between one of the WDP joints and a non-wired section of the drill string (see, e.g., FIG. 1C), whereby the non-wired section of the drill string may be converted to a cabled section by a second communication link. In the alternative embodiment, the non-wired section of the drill string may include one or more non-wired drill pipe joints and/or non-wired utility subs.

The inventive telemetry system of the present invention contemplates the use of a plurality of adapter subs 9 (i.e., not merely two) preferably disposed at the above-mentioned spacing interval of 1000 feet (304.8 m) within the drill string. Each of the adapter subs 9 is adapted for connecting to a second cable 112 disposed within the drill string 6, as described above with reference to FIGS. 2A–B. In this manner, the spaced adapter subs serve dual purposes: (1) a conduit in the first communication link 5*a* defined by WDP joints; and (2) as "jumpers" ready to bypass or jump across, e.g., one or more defective WDP joints in the first communication link 5*a*, as needed.

In most embodiments (see FIG. 1A), the telemetry system 100 will further include one or more measurement tools M disposed in a lower section of the drill string 6 known as a bottom hole assembly (BHA) 200. Also included is a surface computer 2 for processing data acquired by the measurement tool(s) M, and a first communication sub 70 disposed in or above an upper section of the drill string (above kelly joint 17) for communicating with the surface computer 2. The first communication sub 70, also known as a surface communication sub, also communicates with the first communication link 5*a* and the second communication link 5*b* by connection means that are known in the art. The telemetry system 100 further includes a second communication sub 80, also known as a downhole communication sub, disposed in a lower section of the drill string 6 just above the BHA 200 for communicating with (at least) the measurement tool(s) M. The first communication link 5*a* provides at least a portion of an operative communicative connection between the downhole communication sub 80 and the surface communication sub 70. A second cable 112 may be disposed within the drill string 6 and connected across a pair of adapter subs 9, thereby forming the second communication link 5*b* (or a part thereof) connected for communication with the first communication link 5*a*. The second communication link 5*b* thus provides at least a portion of an operative communicative connection between the downhole communication sub 80 and the surface communication sub 70, e.g., as a bypass or supplement to link 5*a*.

In various embodiments of the telemetry system, the first (or surface) communication sub 70 is located according to one of four configurations: beneath the kelly joint 17 in the (rotary table-driven) drill string 6; above the kelly joint in the (rotary table-driven) drill string; beneath a power swivel supporting the (top-driven) drill string (not shown); or within a power swivel supporting the (top-driven) drill string (not shown). If disposed above a kelly joint in the drill string, the first communication sub may include a slip ring or a rotary transformer for communicating signals between the rotating drill string 6 and the stationary surface components of the telemetry system 100.

The top-driven drill string is similar to the rotary table-drive drill string 6 depicted in FIG. 1A, except the rotary table 16 and swivel 19 are replaced with a power swivel that supports and rotates the drill string.

A slip ring (also known as brush contact surfaces) is a well known electrical connector designed to carry current or signals from a stationary wire into a rotating device. Typically, it is comprised of a stationary graphite or metal contact (a brush) carried in a non-rotating component 1 (e.g., within swivel 19) which rubs on the outside diameter of a rotating metal ring (e.g., carried on the upper portion of kelly joint 17). As the metal ring turns, the electrical current or signal is conducted through the stationary brush to the metal ring making the connection. Plural ring/brush assemblies may be stacked along the rotating axis if more than one electrical circuit is needed.

Rotary electrical couplings based on induction (transformer action), known as rotary transformers, provide an alternative to slip rings and contact brushes based upon conduction between rotating and stationary circuitry. Thus, no direct contact is necessary for transformer action to occur in an inductive rotary coupling. FIG. 6 shows a simplified cross section of a typical inductive rotary coupling between a stationary circuit 72 mounted within a stationary housing 1 and a rotating circuit (which includes communication links 5*a* and/or 5*b*) mounted on the kelly joint 17. The transformer windings comprise a stationary coil 74 and a rotating coil 76, both concentric with the axis of rotation. Either coil can serve as the primary winding, with the other serving as the secondary winding. The stationary assembly includes a transformer core that, like a conventional stationary power transformer, is made by stacking sheets of silicon steel or other suitable magnetically "soft" material, except the core has an inner portion 77 and an outer portion 78 that define a shape to accommodate the rotating parts. The hollow shaft accommodates the wires that connect the rotating coil with the rotating circuit at one end of the shaft.

As mentioned above, the drillstring 6 typically includes a bottom hole assembly (BHA) 200 disposed near the drill bit 15. The BHA 200 may include capabilities for measuring, processing, and storing information, as well as communicating with the surface (e.g., MWD/LWD tools) via a downhole communication sub 80. An example of a measurement tool M having such capabilities for resistivity determination is described in detail in U.S. Pat. No. 5,339,037.

A signal representing one or more measurements from the BHA 200 is transmitted up the drill string 6 from measurement tool(s) M via downhole communication sub 80. Transmission may be achieved by conventional means, such as mud-pulse telemetry, electromagnetic telemetry, and pipe acoustic telemetry, or, more advantageously, by communication links 5*a*, 5*b* as described herein. The transmitted signal is received by surface communication sub 70 which, in certain embodiments, employs means coupled to the kelly joint 17 such as a slip ring or rotary transformer 1 for communicating the signal from a rotating circuit to a stationary circuit within swivel 19. The stationary circuit of the transformer or slip ring is coupled via a wired connection, such as cable 3, to a surface computer 2 for processing and storage/display. The surface computer 2 also provides for communication with, and control of, measurement tool(s) M via appropriate signals directed back down the drill string 6. The rotating circuit of the rotary transformer or slip ring is also coupled to the downhole communication sub 80 via the communication links 5*a*, 5*b*, described above, extending through the drill string 6.

FIG. 7A shows a schematic representation of an alternative telemetry system 100*a* having a surface wireless communication link instead of the wired couplers described above. The telemetry system 100*a* is essentially the same as the telemetry system 100 of FIG. 1A, except that a surface communication sub 70*a* is operatively coupled to the kelly 17 in place of the surface communication sub 70 having the rotary transformer or slip ring. In this embodiment, a wireless connection 3*a* exists between the surface computer 2*a* and the surface communication sub 70*a*. The surface communication sub 70*a* is operatively connected to the downhole communication sub 80*a* via the communication links 5*a*, 5*b* as previously described.

The surface communication sub 70*a* includes a WDP modem 315 in wired communication with the first communication link 5*a*, a wireless modem 325 in wired communication with the WDP modem 315, and a power supply 310 powering the modems. The power supply may include one or more batteries 305.

The surface communication sub 70*a* is preferably a short adapter sub, or a WDP surface communication sub, which provides an interface between the wireless communication link and the piped communication link (also referred to herein as the first communication link) 5*a*.

The WDP modem 315 enables communication between the surface communication sub 70*a* and the piped communication link 5*a* of the WDP system. The wireless modem 325 enables communication between the surface communication sub and the surface computer via the wireless connection 3*a*. The WDP modem and the wireless modem are operatively coupled by a high-speed link 320. The surface communication sub 70*a* and the surface computer 2*a* are each provided with respective wireless transceivers 325*t*, 2*t* capable of wirelessly sending and receiving signals therebetween via the wireless connection 3*a*.

Figure 7B:
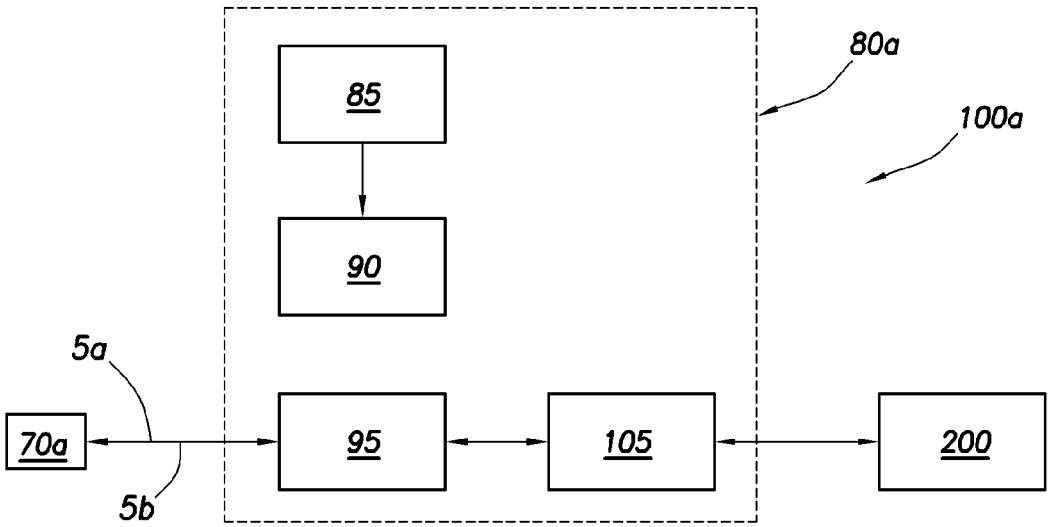
FIG. 7B is a schematic representation of a downhole communication link according to another aspect of the present invention.

FIG. 7B shows a schematic representation of a conventional downhole communication sub 80*a* employing aspects of the present invention. Sub 80*a* includes a WDP modem 95 for communicating through the piped communication link 5*a*, 5*b* with the surface communication sub 70*a*. WDP modem 95 is wired for high speed communications with bus network interface 105, which is in turn communicatively connected with the BHA 200. A power supply 90 powers the downhole communication sub 80*a*, and may include one or more batteries 85.

The telemetry system represented collectively by FIGS. 7A and 7B enables a wireless communication link (also referred to herein as a third communication link) at the surface to cooperate with piped and/or cabled communication links in the wellbore.

Figure 8:
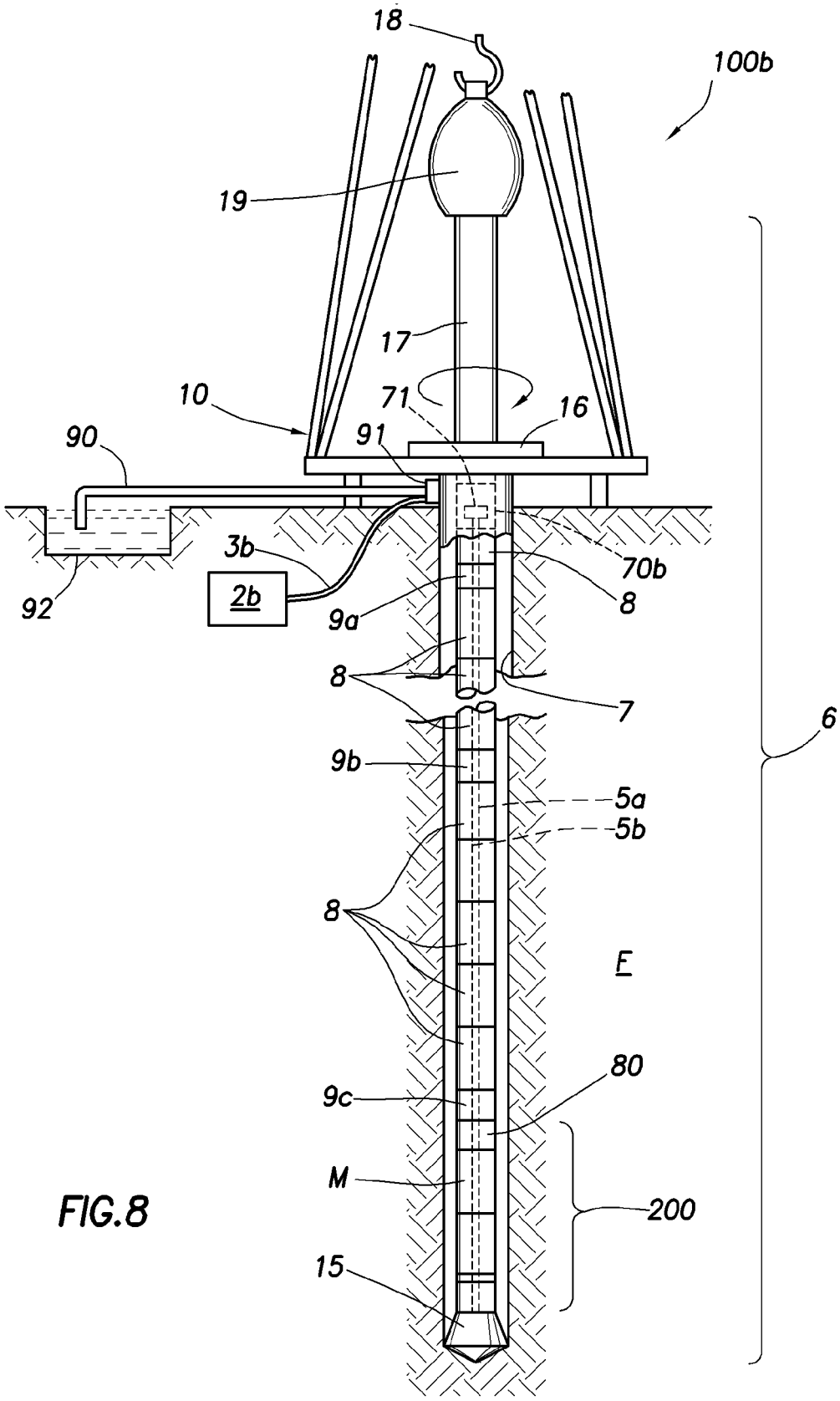
FIG. 8 is an elevational representation of a drill string having a telemetry system that includes a piped communication link, a cabled communication link, and a wireless communication link in accordance with one aspect of the present invention.

FIG. 8 shows yet another embodiment of the telemetry system, labeled 100*b*, wherein a surface communication sub 70*b* is disposed in the drill string beneath a portion of the drill string engaged by the torque-applying mechanism (e.g., beneath rotary table 16) for wirelessly-communicating with the surface computer 2*b*. The surface communication sub 70*b* includes a first wireless transceiver 71, and the telemetry system further includes a second wireless transceiver 91 disposed in a mud return line 90 connected between a mud pit 92 and the wellbore. It is desirable for the transceiver 91 to be positioned as closely as possible to the drill string 6, and the location of the transceiver 91 along the mud return line 90 is not essential. Thus, alternative locations, such as a nearby riser or casing pipe joint, may be similarly employed to advantage. The second wireless transceiver 91 is in wired communication with the surface computer 2*b* via cable 3*b*. The downhole communication sub 80 may communicate with the surface communication sub 70*b* in a number of ways, including conventional mud-pulse telemetry and wired links particularly according to communication links 5*a*, 5*b*.

Figure 9:
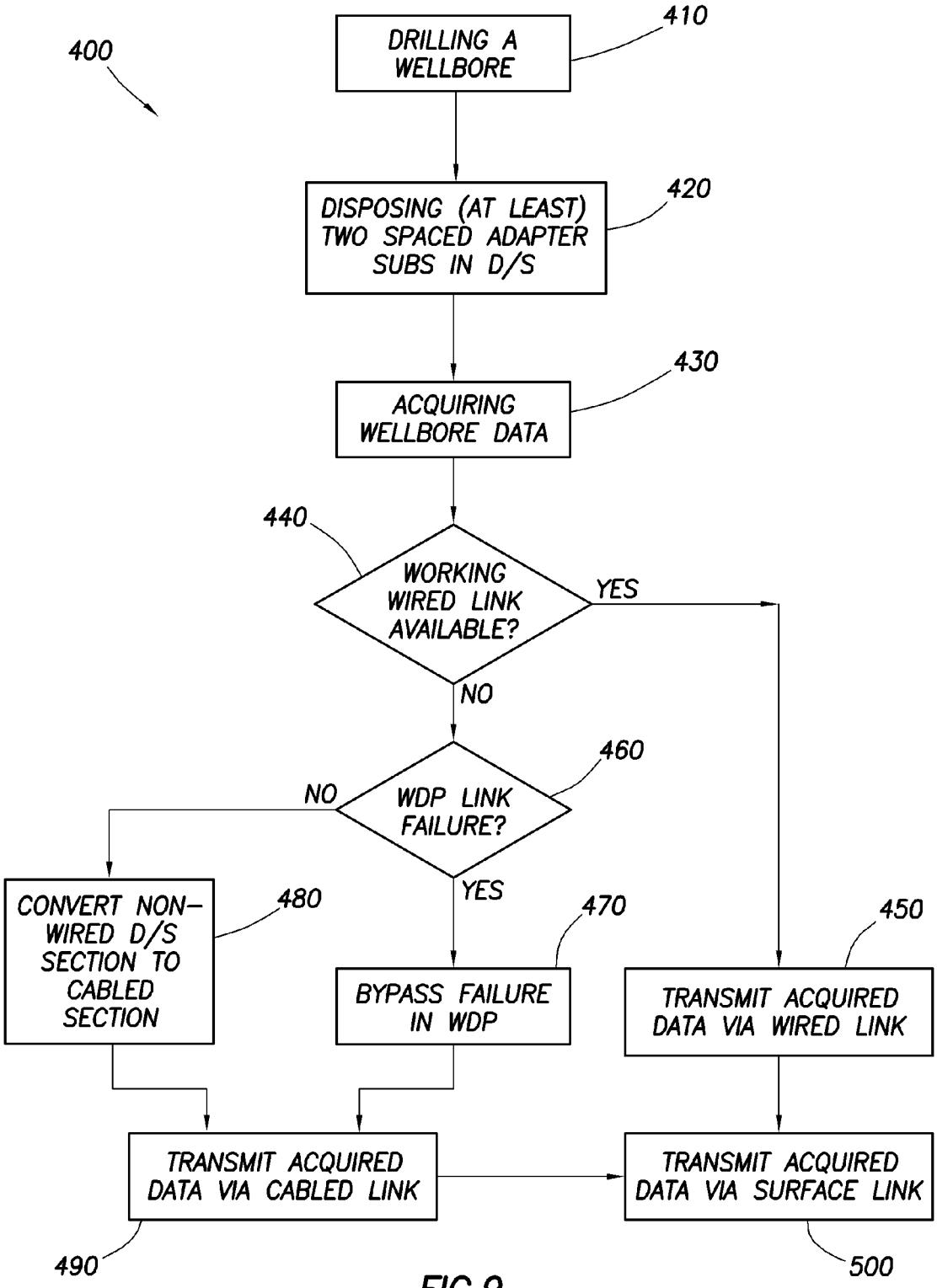
FIG. 9 is a decision flow diagram for a downhole drilling method according to one aspect of the present invention and FIG. 10 is a decision flow diagram for a downhole drilling method according to one aspect of the present invention.

The present invention further provides a method of downhole drilling 400 that employs the telemetry systems described above to advantage. Thus, with reference particularly to FIG. 9 and generally to the other figures, the method 400 includes the steps of drilling a wellbore with a drill string 6 (step 410), acquiring wellbore data with a measurement tool M disposed in the drill string 6 while drilling (step 430), and transmitting the acquired wellbore data to the surface of the wellbore via a cabled communication link 5*b* (step 490). The cabled communication link 5*b* is defined by at least two spaced apart adapter subs 9 disposed within the drill string 6 and a cable 112 connecting the adapter subs for transmitting signals between the adapter subs (step 420), as described herein.

The downhole drilling method 400 further includes the step of transmitting the acquired wellbore data to the surface of the wellbore via another communication link 5*a* defined by a plurality of interconnected WDP joints 8 (step 440: "yes" to step 450), and the step of transmitting the acquired wellbore data to the surface of the wellbore via a third communication link defined by a surface communication sub 70/70*a*/70*b* (step 500) wired for communication to the interconnected WDP joints 8. The surface communication sub 70/70*a*/70*b* transmits the acquired wellbore data from the interconnected WDP joints 8 to a surface computer 2/2*a* for processing, and may use one or more wireless transceivers 71, 91 for this purpose (refer, e.g., to FIG. 8).

The transmitting step 490 is enabled by using the second communication link 5*b* to bypass a portion of the first communication link 5*a* (step 470) once a failure has been attributed to the first communication link 5*a* (step 460), or alternatively, to convert a non-wired section NW of the drill string into a cabled section (step 480).

The identification of a failure in the WDP system (step 460) may be achieved by passing a signal through the first communication link 5*a*, and then measuring the signal to determine the voltage and/or current, and the impedance. By analyzing the impedance, the fault location may be determined. In particular, the impedance may have a ripple or strong resonance which indicates a fault. The received signal may also be measured in the time domain. The delay of the signal between the transmission and receipt may be analyzed to determine the location of a fault by indicating the distance the signal travels. This information may also be used to determine the number of failed WDP joints.

Figure 10:
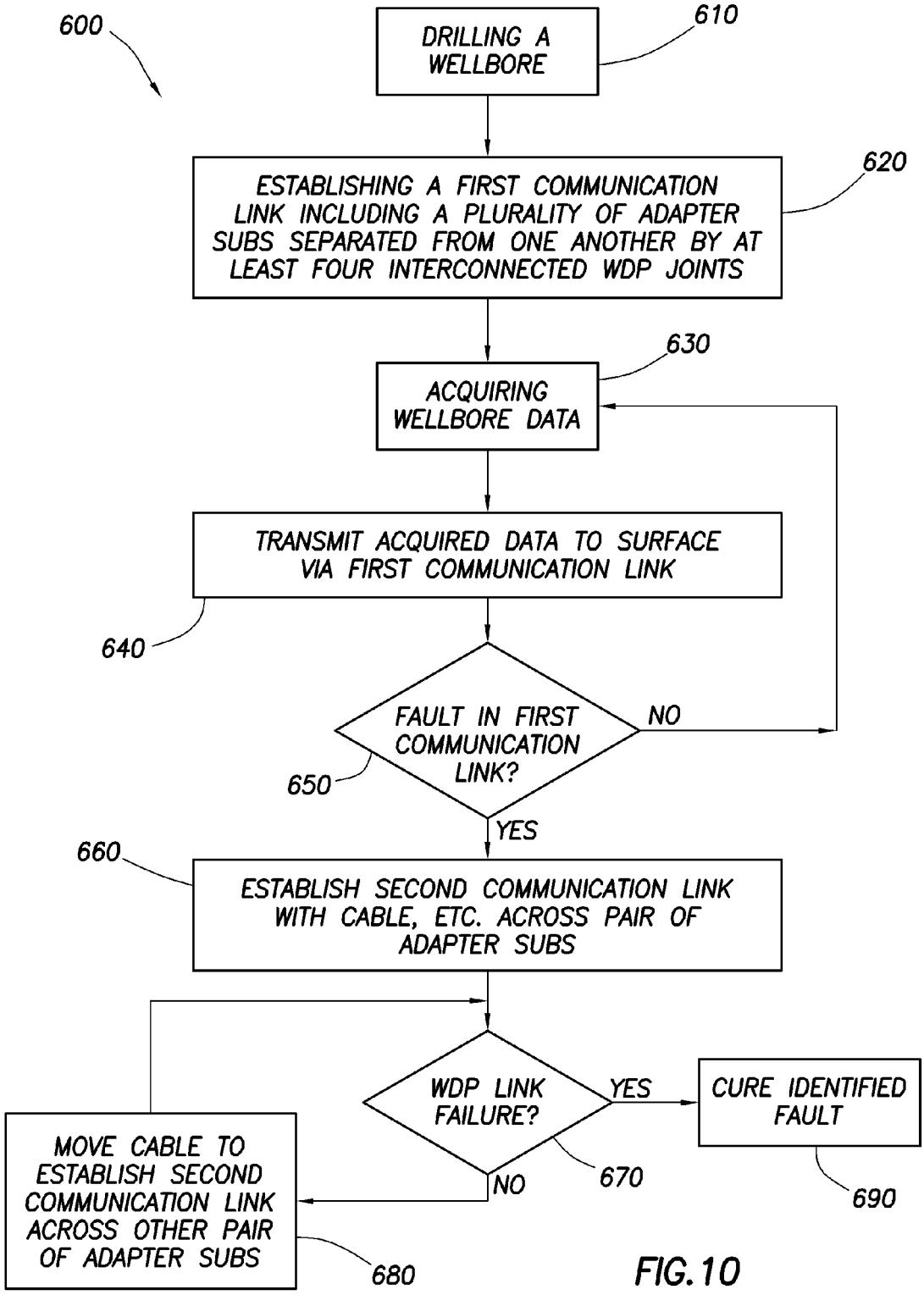

FIG. 10, as well as the other figures in general, illustrate yet a further aspect of the present invention in the form of a downhole drilling method 600. A wellbore is drilled (step 610) with a drill string 6 having a plurality of adapter subs 9 disposed therein. Successive adapter subs within the drill string are separated by at least four interconnected wired drill pipe joints 8. The adapter subs 9 and wired drill pipe joints 8 together define a first communication link 5*a* (step 620). Wellbore data is acquired while drilling with a measurement tool M disposed in the drill string 6 (step 630), and the acquired wellbore data is transmitted to the surface of the wellbore via the first communication link 5*a* (step 640).

Upon detecting the presence of a fault in the first communication link 5*a* (step 650: YES), e.g., due to inability to communicate with the measurement tool M, a cable 112 is disposed within the drill string 6 for establishing a second communication link 5*b* (step 660). The cable 112 has a pair of spaced sub connectors 118 connected in series along the cable for establishing communication with a respective pair of consecutive adapter subs 9, such as the lowest pair of adapter subs in the drill string 6. In this manner, the second communication link 5*b* is established by such communication. In other words, the pair of sub connectors 118 communicatively couple to the pair of respective adapter subs 9, as described in detail herein. The second communication link 5*b* bypasses the interconnected wired drill pipe joints 8 between the pair of consecutive adapter subs 9.

A determination is then made whether the fault lies within the portion of the drill string between the pair of consecutive adapter subs 9 connected via cable 112 (step 670). Upon determining that the fault does not lie within the portion of the drill string between the pair of cabled, consecutive adapter subs (step 670: NO), the cable is moved within the drill string to establish communication between the pair of sub connectors and other respective pairs of consecutive adapter subs (step 680) until the location of the fault is identified. Preferably, the cable is moved so as to bypass each successive interconnected string of wired drill pipe joints between consecutive adapter subs 9. Once the fault is identified, e.g., by the unsuccessful return of a test signal, the fault may be cured (step 690) by replacing defective joint(s) 8 of wired drill pipe during a trip of the drill string 6.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A cabled communication link for a drill string, comprising:

at least two adapter subs spaced apart within the drill string by a distance that exceeds the length of three interconnected drill pipe joints; and a cable connecting the two adapter subs for communication of a signal therebetween.

2. The cabled communication link of claim 1, wherein each of the adapter subs includes a communicative coupler intermediate its ends, and the cable has a pair of sub connectors carried in series thereby, each of the sub connectors having a complementing communicative coupler, whereby alignment of a sub connector's complementing communicative coupler with the communicative coupler of an adaptor sub establishes communication therebetween.

3. The cabled communication link of claim 2, wherein each of the adapter subs further includes an inner annular recess spaced a predetermined axial distance from the communicative coupler, and each of the sub connectors further has a latch for engaging the inner annular recess of one of the adapter subs and positioning its complementing communicative coupler in alignment with the communicative coupler of the one adapter sub.

4. The cabled communication link of claim 3, wherein the latch of each of the sub connectors includes a locking dog having at least one key for engaging the annular recess of one of the adapter subs, the key being spaced from the complementing communicative coupler of each sub connector by the predetermined axial distance, whereby engagement by the key with the annular recess of one of the adapter subs when the cable is disposed within the drill string aligns the sub connector's complementing communicative coupler with the communicative coupler of the one adaptor sub and establishes communication therebetween.

5. The cabled communication link of claim 4, wherein the locking dog includes a detent latch.

6. The cabled communication link of claim 2, wherein the communicative couplers and complementing communicative couplers are inductive couplers.

7. The cabled communication link of claim 1, wherein a plurality of wired drill pipe joints are interconnected within the drill string between the two adapter subs to form a piped communication link, whereby the cabled communication link establishes an alternative pathway to the piped communication link for transmitting a signal through the drill string.

8. The cabled communication link of claim 1, wherein a non-wired section of the drill string is disposed between the two adapter subs, whereby the cabled communication link establishes a pathway for transmitting a signal through the non-wired section of the drill string.

9. The telemetry system of claim 8, wherein the non-wired section of the drill string includes one or more non-wired drill pipe joints.

10. The telemetry system of claim 8, wherein the non-wired section of the drill string includes one or more non-wired utility subs.

11. A telemetry system for a drill string disposed within a wellbore, comprising:

a plurality of wired drill pipe joints within the drill string that form a first communication link, each of the wired drill pipe joints having a communicative first coupler at or near each end thereof, and a first cable connecting the communicative first couplers; and a pair of adapter subs spaced apart within the drill string by a distance tat exceeds the length of three interconnected drill pipe joints, each of the adapter subs having a communicative second coupler at or near at least one of the adapter sub's ends, and being adapted for connection to a second cable disposed in the drill siring such tat a second cable connects the pair of adapter subs to form a second communication link, one of the adapter subs being connected in the drill string such that its communicative second coupler is adjacent a communicative first coupler of one of the wired drill pipe joints to couple the one adapter sub to the one wired drill pipe joint for communication therebetween, whereby the first communication link may be coupled for communication with a second communication link to transmit signals through the drill string.

12. The telemetry system of claim 11, wherein the one adapter sub is connected between two of the wired drill pipe joints within the drill string, whereby a portion of the first communication link may be bypassed by a second communication link.

13. The telemetry system of claim 11, wherein the one adapter sub is connected between the one wired drill pipe joint and a non-wired section of the drill string, whereby the non-wired section of the drill string may be converted to a cabled section by a second communication link.

14. The telemetry system of claim 13, wherein the non-wired section of the drill string includes one or more non-wired drill pipe joints.

15. The telemetry system of claim 13, wherein the non-wired section of the drill string includes one or more non-wired utility subs.

16. The telemetry system of claim 11, wherein the communicative first couplers of the wired drill pipe joints and the communicative second couplers of the adapter subs are inductive couplers.

17. The telemetry system of claim 11, further comprising a second cable disposed within the drill string for connecting the pair of adapter subs to form a second communication link coupled for communication with the first communication link.

18. The telemetry system of claim 17, wherein each of the adapter subs includes a communicative third coupler intermediate the communicative second couplers, and the second cable has a pair of sub connectors carried in series thereby, each of the sub connectors having a communicative fourth coupler, whereby alignment of the sub connector's communicative fourth coupler with the communicative third coupler of the one adapter sub establishes communication between the first communication link and the second communication link.

19. The telemetry system of claim 18, wherein each of the adapter subs further includes an inner annular recess spaced a predetermined axial distance from the communicative third coupler, and each of the sub connectors further has a latch for engaging the inner annular recess of an adapter sub and positioning its communicative fourth coupler in alignment with the communicative third coupler of the engaged adapter sub.

20. The telemetry system of claim 18, wherein the latch of each of the sub connectors includes a locking dog having at least one key for engaging the inner annular recess of one of the adapter subs, the key being spaced from the communicative fourth coupler of each sub connector by the predetermined axial distance, whereby engagement by the key with the annular recess of an adapter sub when the cable is disposed within the drill string aligns the sub connector's communicative fourth coupler with the communicative third coupler of the engaged adaptor sub and establishes communication therebetween.

21. The telemetry system of claim 20, wherein the locking dog includes a detent latch.

22. The telemetry system of claim 18, wherein the communicative third couplers and the communicative fourth couplers are inductive couplers.

23. The telemetry system of claim 11, comprising a plurality of adapter subs disposed at spaced intervals within the drill strings, each of the adapter subs being adapted for connecting to a second cable disposed within the drill string such that a second cable can connect at least two of the adapter subs to form a second communication link, one of the adapter subs being connected in the drill string such that its communicative second coupler is adjacent a communicative first coupler of one of the wired drill pipe joints to couple the one adapter sub to the one wired drill pipe joint for communication therebetween, whereby the first communication link may be coupled for communication with a second communication link.

24. The telemetry system of claim 23, further comprising a second cable disposed within the drill string for connecting the one adapter sub and at least one other of the plurality of adapter subs to form a second communication link coupled for communication to the first communication link.

25. The telemetry system of claim 11, further comprising:

a measurement tool disposed in a lower section of the drill string;

a surface computer for processing data acquired by the measurement tool;

a first communication sub disposed in or above an upper section of the drill string for communicating with the surface computer; and a second communication sub disposed in the lower section of the drill string for communicating with the measurement tool;

the first communication link providing at least a portion of an operative communicative connection between the downhole communication sub and the surface communication sub.

26. The telemetry system of claim 25, wherein the measurement tool is also an adapter sub.

27. The telemetry system of claim 25, further comprising a second cable disposed within the drill string and connected across the pair of adapter subs, thereby forming a second communication link connected for communication with the first communication link, the second communication link also providing at least a portion of an operative communicative connection between the downhole communication sub and the surface communication sub.

28. The telemetry system of claim 25, wherein the first communication sub is disposed beneath a kelly joint in the drill string.

29. The telemetry system of claim 25, wherein the first communication sub is disposed above a kelly joint in the drill string.

30. The telemetry system of claim 25, wherein the first communication sub is disposed beneath a power swivel supporting the drill string.

31. The telemetry system of claim 25, wherein the first communication sub is disposed within a power swivel supporting the drill string.

32. The telemetry system of claim 29, wherein the first communication sub includes a rotary transformer.

33. The telemetry system of claim 29, wherein the first communication sub includes a slip ring.

34. The telemetry system of claim 25, wherein the first communication sub includes a first wireless transceiver in wired communication with the first communication link.

35. The telemetry system of claim 34, further comprising a second wireless transceiver in wired communication with the surface computer, the first and second wireless transceivers being adapted for wireless communication therebetween.

36. The telemetry system of claim 35, wherein the second wireless transceiver is disposed in a mud return line connected between a mud pit and the wellbore.

37. The telemetry system of claim 25, wherein the first communication sub includes:

a wired drill pipe modem in wired communication with the first communication link;

a wireless modem in wired communication with the wired drill pipe modem; and a power supply powering the modems.

38. The telemetry system of claim 37, wherein the power supply includes one or more batteries.

39. A telemetry system for a drill string, comprising:

a plurality of wired drill pipe joints within the drill string that form a first communication channel, each of the wired drill pipe joints having communicative first couplers at or near both ends thereof, and a cable connecting the communicative first couplers; and a pair of adapter subs spaced apart within the drill string by a distance that exceeds the length of three interconnected drill pipe joints, each of the adapter subs having a communicative second coupler at or near at least one of its ends, and being adapted for connection to a second cable disposed within the drill string such that the second cable connects the pair of adapter subs to form a second communication channel, one of the adapter subs being connected in the drill string such that its communicative second coupler is adjacent a communicative first coupler of one of the wired drill pipe joints to couple the one adapter sub to the one wired drill pipe joint for communication therebetween, whereby the first communication channel may be coupled for communication with a second communication channel to transmit signals through the drill string.

40. The telemetry system of claim 39, further comprising a second cable disposed within the drill string for connecting the pair of adapter subs to form a second communication channel coupled for communication with the first communication channel.

41. A telemetry system for a drill string disposed in a wellbore, the drill string including a plurality of interconnected drill pipe joints suspended by a derrick and engaged by a torque-applying mechanism for rotation thereof, a measurement tool suspended by the drill pipe joints for acquiring wellbore data, a downhole communication sub suspended by the drill pipe joints for communicating with the measurement tool via the drill pipe joints, and a drill bit defining the lower end of the drill string, the system comprising:

a surface computer for processing data acquired by the measurement tool; and a surface communication sub disposed in the drill string beneath a portion of the drill string engaged by the torque-applying mechanism for wirelessly-communicating with the surface computer, the surface communication sub communicating with the downhole communication sub via the drill pipe joints.

42. The telemetry system of claim 41, wherein the surface communication sub includes a first wireless transceiver, and the telemetry system further comprises a second wireless transceiver disposed in a mud return line connected between a mud pit and the wellbore, the second wireless transceiver being in wired communication with the surface computer.

43. The telemetry system of claim 41, wherein the downhole communication sub communicates with the surface communication sub via mud-pulse telemetry.

44. The telemetry system of claim 41, wherein the downhole communication sub communicates with the surface communication sub via electromagnetic telemetry.

45. The telemetry system of claim 41, wherein the downhole communication sub communicates with the surface communication sub via pipe acoustic telemetry.

46. The telemetry system of claim 41, wherein at least some of the drill pipe joints are sequentially-connected wired drill pipe joints having a first communication link therethrough providing at least a portion of an operative communicative connection between the downhole communication sub and the surface communication sub.

47. The telemetry system of claim 46, further comprising a means for forming a second communication link coupled for communication with the first communication link.

48. The system of claim 47, wherein each of the wired drill pipe joints have communicative first couplers at or near both ends thereof, and a first cable connecting the communicative first couplers, and the second communication link-forming means includes a pair of adapter subs spaced apart within the drill string by a distance that exceeds the length of three interconnected drill pipe joints, each of the adapter subs having a communicative second coupler at or near at least one of its ends, and being adapted for connection to a second cable disposed within the drill string such that a second cable connects the pair of adapter subs to form a second communication link, one of the adapter subs being connected in the drill string such that its communicative second coupler is adjacent a communicative first coupler of one of the wired drill pipe joints to couple the one adapter sub to the one wired drill pipe joint for communication therebetween, whereby the first communication link may be coupled for communication with a second communication link to transmit signals through the drill string.

49. The telemetry system of claim 48, wherein the measurement tool also functions as an adapter sub.

50. The telemetry system of claim 48, further comprising a second cable disposed within the drill string for connecting the pair of adapter subs to form a second communication link coupled for communication with the first communication link.

51. The telemetry system of claim 50, wherein each of the adapter subs includes a communicative third coupler intermediate the communicative second couplers, and the second cable has a pair of sub connectors carried in series thereby, each of the sub connectors having a communicative fourth coupler, whereby alignment of the sub connector's communicative fourth coupler with the communicative third coupler of an adapter sub establishes communication therebetween.

52. A downhole drilling method, comprising the steps of:

drilling a wellbore with a drill string;

acquiring wellbore data while drilling with a measurement tool disposed in the drill string; and transmitting the acquired wellbore data to the surface of the wellbore via a communication link defined by at least two adapter subs spaced apart within the drill string by a distance that exceeds the length of three interconnected drill pipe joints and a cable connecting the adapter subs for transmitting signals between the adapter subs.

53. The method of claim 52, further comprising the step of transmitting the acquired wellbore data to the surface of the wellbore via another communication link defined by a plurality of interconnected wired drill pipe joints.

54. The method of claim 53, further comprising the step of transmitting the acquired wellbore data to the surface of the wellbore via a third communication link defined by a surface communication sub wired for communication to the interconnected wired drill pipe joints, the surface communication sub transmitting the acquired wellbore data from the interconnected wired drill pipe joints to a surface computer for processing.

55. The method of claim 54, wherein the surface communication sub employs a wireless transceiver for transmitting the acquired wellbore data to the surface computer.

56. A downhole drilling method, comprising the steps of:

drilling a wellbore with a drill string;

acquiring wellbore data while drilling with a measurement tool disposed in the drill string; and transmitting the acquired wellbore data to the surface of the wellbore via a first communication link defined by a plurality of wired drill pipe joints and a second communication link defined by at least a pair of adapter subs spaced apart by a distance that exceeds the length of three interconnected drill pipe joints, the adapter subs being connected by a second cable for communication of signals between the adapter subs.

57. The downhole drilling method of claim 56, wherein the transmitting step includes using the second communication link to bypass a portion of the first communication link.

58. The downhole drilling method of claim 56, wherein the step of transmitting includes using the second communication link to convert a non-wired section of the drill string into a cabled section.

59. A downhole drilling method, comprising the steps of:

drilling a wellbore with a drill string having a plurality of adapter subs disposed therein, successive adapter subs being separated by at least four interconnected wired drill pipe joints, the adapter subs and wired drill pipe joints together defining a first communication link;

acquiring wellbore data while drilling with a measurement tool disposed in the drill string;

transmitting the acquired wellbore data to the surface of the wellbore via the first communication link;

upon detecting the presence of a fault in the first communication link, disposing a cable within the drill string having a pair of spaced sub connectors connected in series along the cable for establishing communication with a respective pair of consecutive adapter subs, whereby a second communication link is established by such communication that bypasses the interconnected wired drill pipe joints between the pair of consecutive adapter subs.

60. The downhole drilling method of claim 59, further comprising the steps of:

determining if the fault lies within the portion of the drill string between the pair of consecutive adapter subs;

upon determining that the fault does not lie within the portion of the drill string between the pair of consecutive adapter subs, moving the cable within the drill string to establish communication between the pair of sub connectors and other respective pairs of consecutive adapter subs until the location of the fault is identified; and curing the fault.

* * * * *